US005438707A

United States Patent [19]

Horn

[11] Patent Number: 5,438,707

[45] Date of Patent: Aug. 8, 1995

[54] BODY COOLING APPARATUS

[76] Inventor: Stephen T. Horn, R.R. 2 Box 4800, White Stone, Va. 22578

[21] Appl. No.: 333,787

[22] Filed: Nov. 3, 1994

Related U.S. Application Data

[63] Continuation of Ser. No. 53,661, Apr. 29, 1993, abandoned.

[51] Int. Cl.[6] ..... A41D 13/00

[52] U.S. Cl. ..... 2/69; 2/2; 2/81

[58] Field of Search ..... 2/2, 2.15, 69, 84, 81, 2/102, DIG. 1; 62/259.3, 384, 385, 388; 128/379, 380, 386, 399, 400, 385; 165/46

[56] References Cited

U.S. PATENT DOCUMENTS

| | | | |
|---|---|---|---|
| 3,411,156 | 11/1968 | Feher | 2/215 |
| 3,507,321 | 4/1970 | Palma . | |
| 3,570,264 | 3/1971 | Curtis . | |
| 3,610,323 | 10/1971 | Troyer | 62/259.3 |
| 3,738,367 | 6/1973 | Hardy | 128/399 |
| 3,744,053 | 7/1973 | Parker et al. . | |
| 4,118,946 | 10/1978 | Tubin | 62/384 |
| 4,390,997 | 7/1983 | Hinz et al. | 2/81 |
| 4,738,119 | 4/1988 | Zafred | 2/81 |
| 4,964,282 | 10/1990 | Wagner . | |
| 4,979,375 | 12/1990 | Nathans et al. . | |
| 4,998,415 | 3/1991 | Larsen . | |
| 5,062,269 | 11/1991 | Siegel . | |
| 5,146,625 | 9/1992 | Steele et al. . | |
| 5,255,390 | 10/1993 | Gross et al. | 2/69 |

FOREIGN PATENT DOCUMENTS

| | | | |
|---|---|---|---|
| 963960 | 7/1964 | United Kingdom | 2/81 |

OTHER PUBLICATIONS

Personal Cooling & Heating Systems Brochure, Vortec Corporation.

*Primary Examiner*—Clifford D. Crowder
*Assistant Examiner*—Gloria Hale
*Attorney, Agent, or Firm*—Albert C. Pollard

[57] ABSTRACT

The present invention provides a body cooling garment to easily and effectively cool the human body. By pressurizing air or other compressible gases to a minimum pressure rating of 70 psi and channeling it by means of a tubing network that is incorporated into body garments such as a vest, head covers, and pants, the pressurized air can be transported and dispensed on the individual. Thus a two fold cooling effect is accomplished. First, initial cooling is achieved by the cooling of the pressurized gas itself as it rapidly depressurizes and expands through openings in the tubing resulting in a very cold gas. This effect combined with the flow of air and gases that is created by this expansion of pressurized gas in the vicinity of the body of an individual a wearing such a garment will evaporatively cool the body and compliment the cooling caused by the rapid expansion of the compressed gas.

4 Claims, 3 Drawing Sheets

BODY COOLING APPARATUS

The application is a continuation of application Ser. No. 08/053,661 filed on Apr. 29, 1993 now abandoned.

BACKGROUND OF THE INVENTION

1. Field of the Invention

The present invention relates to body garments capable of cooling the human body. These garments provide cooling of an individual by utilizing rapid expansion of compressed gases adjacent to the wearer to cause a drop in ambient temperature in the air adjacent to the wearer of the garment. These garments further provide cooling to an individual wearing such a garment by means of evaporative cooling from the gas that is moving due to its rapid exit from tubing through which it is circulated about the individual.

2. Description of the Prior Art

Body garments for the purpose of cooling appear in the patent record taking many shapes and forms. However, most of these patents regard body garments that cool through the circulation of a cool liquid through a piping network incorporated into a garment or through the specially constructed garment itself having its own circulatory network. Another focus of the prior art concerns cooling apparatus that cool through evaporative means. These devices are open systems, as opposed to the closed systems mentioned above, that is,they release cool air or vapor onto and over an individuals body to cool through evaporative means.

The present invention works, in a different fashion than these above mentioned patented inventions, by use of a rapidly expanding gas, preferably air, in the inner portion of a body garment in the area between the body garment and the individual to cool the individual not only through evaporative cooling but also by reducing the ambient temperature adjacent the individual due the rapid expansion of the gas being dispensed.

Although some structural elements of the present invention appear arguably similar to those found in the patent record, the patent record does not show a body cooling garment having all of the above mentioned features. For argumentative purposes the prior art is presented as follows:

U.S. Pat. No. 3,507,321, issued to James R. Palma on Apr. 21, 1970, discloses clothing for cooling and heating the body. Palma's clothing affects the human body from the neck down by strategically locating heating coils and cooling conduits through the clothing. Temperature sensors are also incorporated into the clothing for accurate electrical temperature control of the clothing.

U.S. Pat. No. 3,570,264, issued to Daniel L. Curtis on Mar. 16, 1971, discloses an evaporant cooling system comprising a light weight garment having a plurality of tubes connected in a parallel arrangement within the garment for the purposes of cooling the individual wearing same. This invention includes an inlet and an outlet manifold for circulating a liquid water-ammonia solution from a storage tank through the tubes. An exhaust port is also seen in fluid communication with the tubing for allowing the expended evaporant, the ammonia, to leave the system and further cool the individual.

U.S. Pat. No. 3,610,323, issued to Dan E. Troyer on Oct. 5, 1971, also discloses an evaporative cooling garment to be worn by an individual. This garment is seen as a vest-like coat having a plurality of passageways incorporated therein to create a coat from these side-by-side passageways. These passageways are also seen as having a plurality of openings thereon. When used, the Troyer coat is supplied from a reservoir with a quantity of liquid coolant comprising a water and refrigerant, preferably Freon, through an inlet valve. As the body is cooled the refrigerant evaporates, leaving the system, and is replaced from the reservoir until the source has been depleted.

Although the above mentioned two systems have means for bleeding off and releasing evaporated liquid and gas from within the cooling system, they do not teach a fully gas cooling vest capable of rapid depressurization and expansion of a gas to reduce the temperature of the air between a body garment and the body of the individual wearing such a garment. For this reason, it is stated that these references do not teach the present invention.

U.S. Pat. No. 3,744,053, issued to Eugene K. Parker on Jul. 10, 1973, discloses liquid loop garments for heating and cooling the body of and individual. This system is a closed system, releasing no liquid or gas for either heating or cooling purposes. Parker's garments are constructed of two, liquid impervious, material layers having insulation as well as other materials attached thereto.

Jumping ahead to U.S. Pat. No 4,949,375, issued to Robert L. Nathans on Dec. 25, 1990, we see a mat utilizing the same type of closed system for circulating a fluid for cooling purposes that was disclosed in the Parker patent.

U.S. Pat. No. 4,998,415, issued to John D. Larsen on Mar. 12, 1991, discloses a body cooling apparatus including a tubing system for circulating a fluid that is moved not only through the tubing within the apparatus but through a compressor and a condenser in order to remove heat from the body of an individual wearing the apparatus. Larsen's apparatus also includes a head cooling apparatus integrally connecting to the tubing of the main, body supported, apparatus for cooling the head of an individual.

Although tubing for circulating fluids about an individual are seen in these above mentioned patent references, they do not disclose a system that is capable of lowering temperatures in the surrounding air through rapid expansion of a gas.

U.S. Pat. No. 4,964,282, issued to Christopher S. Wagner on Oct. 23, 1990, discloses a detachable bulletproof vest air conditioning apparatus. Wagner's apparatus comprises a piping system that connects to a precooled air source and ducts and channels the air into the interior of the vest, between the vest and the individual, to cool the wearer of said vest. Again, we see another example of evaporative cooling with pre-cooled air moving at standard pressure and a predetermined temperature.

U.S. Pat. Nos. 5,062,269 and 5,146,625 disclose body cooling devices that utilize disposable and removable cooling units.

Lastly, the Personal Cooling and Heating Systems of VORTEC CORPORATION present air cooling body apparatus. These apparatus however, are not fully pressurized at all times since they simply pump expanded and cooled air into the vest and helmet from an expansion chamber outside the vest. These apparatus operate at a maximum pressure of only 100 psi and use a large quantity of air in a range up to 34 cubic feet per minute.

None of the above inventions and patents, taken either singularly or in combination, is seen to describe the instant invention as claimed.

SUMMARY OF THE INVENTION

Accordingly, it is a principal object of the invention to provide a convenient and inexpensive body cooling garment that does not require the use of expensive refrigerants yet still is capable of cooling the body by means of expanding and circulating a gas such as air, CO2, or the like.

It is another object of the invention to accomplish the above mentioned task by means of a body cooling garment that utilizes the affects of rapid expansion of a compressed gas to cool the body of an individual by reducing the temperature of the surrounding air due the infusion of a pressurized gas that is both expanding and cooling at the same time.

It is a further object of the invention to provide inexpensive and substantial cooling to the body of an individual by utilizing complementary cooling effects, evaporative cooling that is present due to the circulation of air, and cooling that will also occur during the rapid expansion of the gas from a tubing network within the garment.

Still another object of the invention is to create a cooling garment that is comfortable to wear and that is capable of cooling an individuals torso, head, lower body, or any combination thereof by having independent garments that may be worn on specific portions of the human body.

Still another object of the invention is to pressurize the gas to a level of at least 70 psi within the tubing of the vest to a maximum practical level of 2000 psi.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(s)

Figure 1:
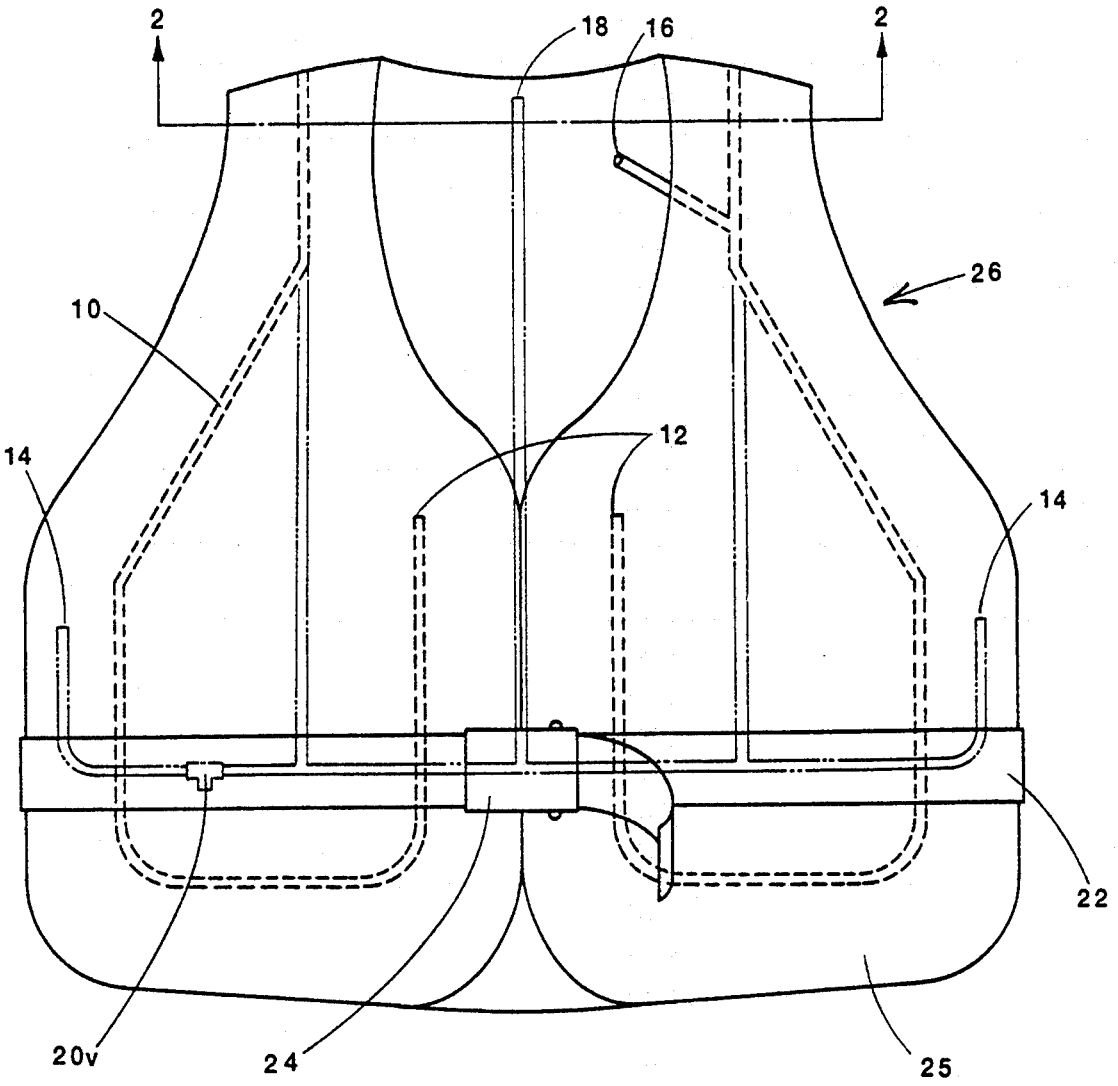
FIG. 1 is a front view of the vest embodiment of the body garment. Tubing in the front panels of the vest are shown in broken lines, tubing in the rear panels of the vest are shown in phantom.

The present invention relates to body garments that cool the body. The present invention is distinct from those already patented in that the greatest amount of cooling comes through the rapid expansion of a gas from a tubing network 10 incorporated into a mesh body garment 25. Pressurized gases above 70 psi, when moved through a preferably 3/16 inch inner diameter, wire reinforced tubing material, and exiting therefrom through small cylindrical shaped openings 11, will expand and dispense so rapidly that the temperature of the air adjacent the body of the individual will be cooled from the cold gas that is, itself, dropping in temperature as it exits the tubing 10 through openings 11 and expands.

Referring now in detail to the drawings, FIG. 1 illustrates the vest embodiment 26 of the mesh body garment 25. A tubing network 10 is incorporated within the vest 26. The tubing 10 has end members with small cylindrical shaped openings at the ends thereof (not shown) at specific "hot spots" on the body in addition to cylindrical shaped openings 11 that are spaced longitudinally along tubing 10 that is adjacent to the body of the wearer. Specifically, tube ends 12 are located at the chest region of the body. Likewise tub ends 14 are located adjacent the wearer's underarm region. Tube end 16 is positioned so that the openings at the end of the tube (not shown) direct the compressed gas towards the face of the individual wearing the vest. Lastly, tube end 18 is located near the top of the spine, between the shoulder blades of the wearer. Connector 20*v* is a typical "quick-release" type fastener that accepts a feed line for a system (not shown) that originates at a compressor or compressed air tanks (both, not shown) that supply the compressed gas to the cooling mesh body garment 26, in this case, vest 26. Through connector 20*v* compressed gases, preferably air or CO2, are passed into cooling vest 26 by tubing 10 at a pressure of at least 70 psi to accomplish minimal cooling. More effective cooling occurs when the pressure from the compressor, or tanks, is in excess of 200 psi, but not higher than 2000 psi at which pressures the tubing network 10 is not efficient and least effective. For enhanced comfort and better fit, vest 26 has a belt member 22 attached thereto capable of being adjusted to different sized waists by adjustable buckle means 24.

Figure 2:
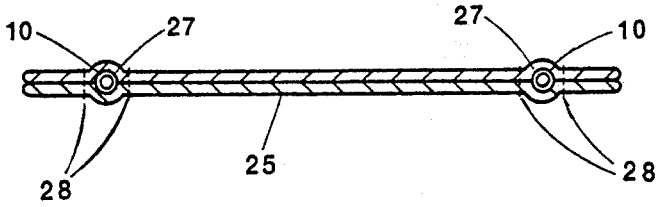
FIG. 2 is a cross-sectional view of the vest embodiment of the body garment along line 2—2 of FIG. 1.

Referring now to FIG. 2, a cross-sectional view of the vest 26 illustrated in FIG. 1 along line 2—2 shows the construction of mesh body garment 25. Two mesh garment layers 25 are laid one over the other and sewn together along the edges in a manner appropriate in the industry for forming a vest 26 from a combination of front and back panel sections not detailed herein. Stitching 28 serves the duel purpose of additional shaping of vest 26 as well as forming passageways 27 to support and hold tubing 10 within vest 26. Hence, stitching 28 is necessary for creating passageways 27 through which tubing 10 and connector 20*v* are incorporated within the vest 26. Furthermore, since passageways 27 are of mesh garment material 25, additional deflection of the depressurizing gas that is leaving tubs 10 through openings 11 will facilitate cooling making vest 26 more effective in its objective to cool and individual wearing such.

Figure 3:
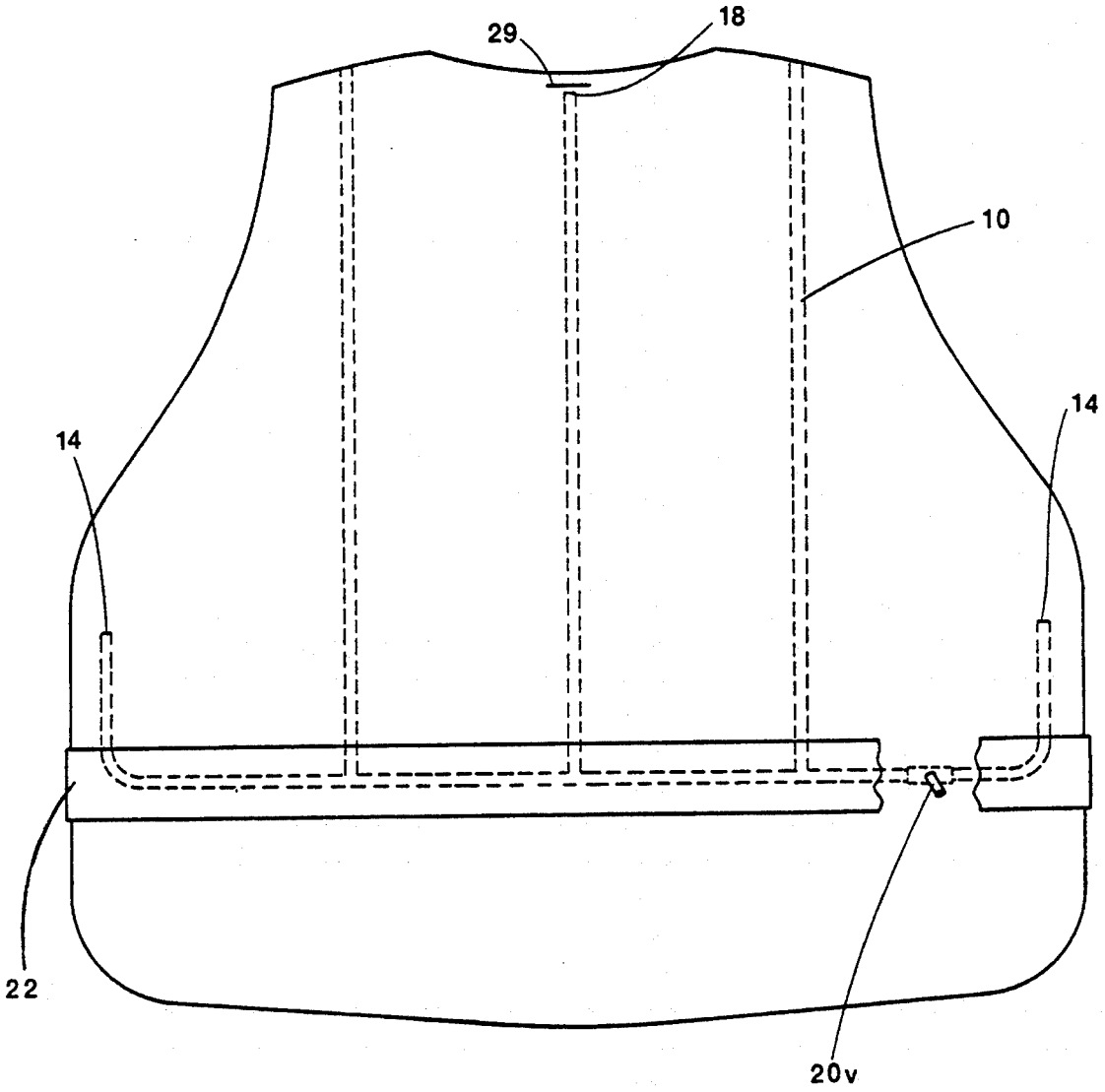
FIG. 3 is a back view of the vest embodiment of the body garment showing only the tubing in the rear panels in broken lines.

FIG. 3 further illustrates the vest 26 embodiment of mesh body garment 25. In this rear view, the arrangement of tubing 10 and connector 20*v* are shown. In addition, tube ends 14 underneath the underarms of the wearer and tube end 18 are clearly seen.

Figure 4:
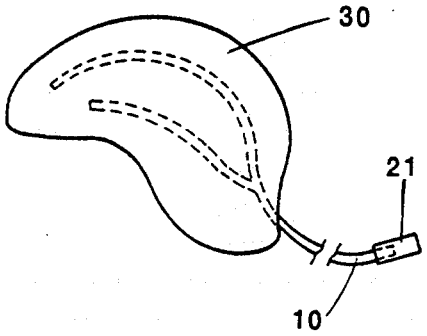
FIG. 4 is a side view of the head cover embodiment of the body garment with the tubing for only that side of the garment shown in broken lines.

Continuing on, FIG. 4 illustrates an additional embodiment of mesh body cooling garment 25. This figure shows from a side view head cover 30 with tubing 10. The head cover 30 encompasses tubing 10 in the same manner as vest 26. Two material mesh garment layers 25 have additional stitching 28 for creating passageways 27 to hold and secure tubing 10 within the head cover 30. In addition, at the distal end of tubing 10 after it has extended from head cover 30 is connector fitting 21. Connector fitting 21 enables tubing 10 of head cover 30 to be connecting with the pressurized gas that is flowing through tubing 10 of vest 26. In this instance, incision-like opening 29 on vest 26 is opened allowing access to tube end 18 located between the shoulder blades of the individual wearing vest 26. Hence, the head may be cooled with the same methods as utilized by the vest 26, while drawing from the same reservoir of compressed gas that is fed into tubing 10 of vest 26 through "quick-release" connector 20*v*.

Figure 5:
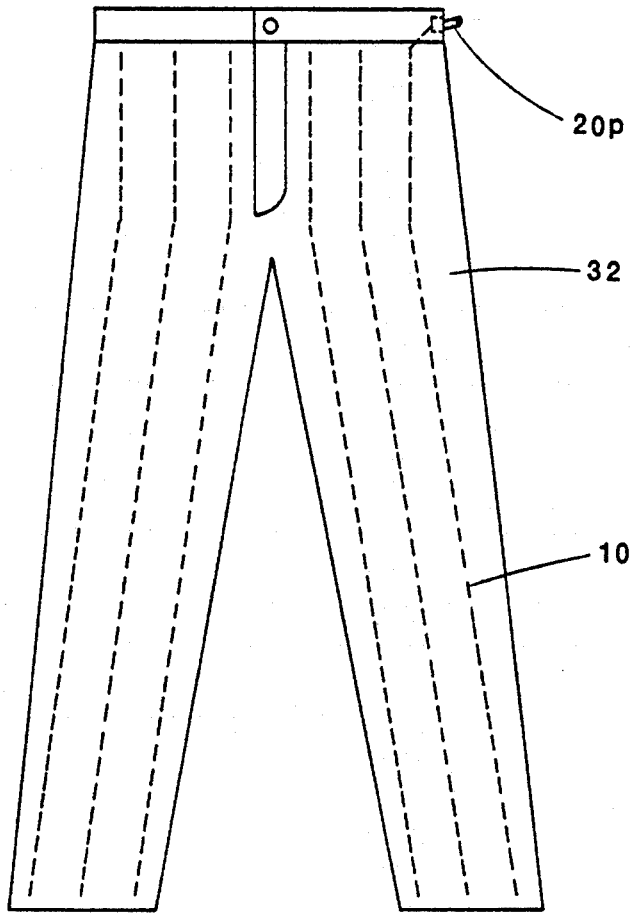
FIG. 5 is a front view of the pants embodiment of the body garment with the tubing for only the front of the garment shown in broken lines.

FIG. 5 illustrates the mesh body garment 25 in an embodiment seen as a pair of pants 32. Tubing 10 is arranged to lie longitudinally along the legs of an individual wearing pants 32. In this instance, two sets of three longitudinally running tubes are utilized on the front of each leg originating in the waist area of the pants and terminating at the cuff area of each pant leg. On the rear of the pants, the same arrangement is utilized, although not shown. In addition, should the wearer of the pants 32 be in a constant sitting position, an appropriate tubing network 10 would be used so that the tubing 10 would not be susceptible to being "pinched" or cut-off, preventing flow to the lower portions of the tubing 10 within pants 32. A "quick-release" connector 20*p* identical to the one used in vest 26 is incorporated into the tubing 10 of the pants so that utilization of pants 32 will not only allow them to be worn on the body without vest 26, but also so as not to create a pressure drop in the system that could result in having a large tubing network 10 that is only fed pressurized gas through a single connector such as 20*v* or 20*p*.

Figure 6:
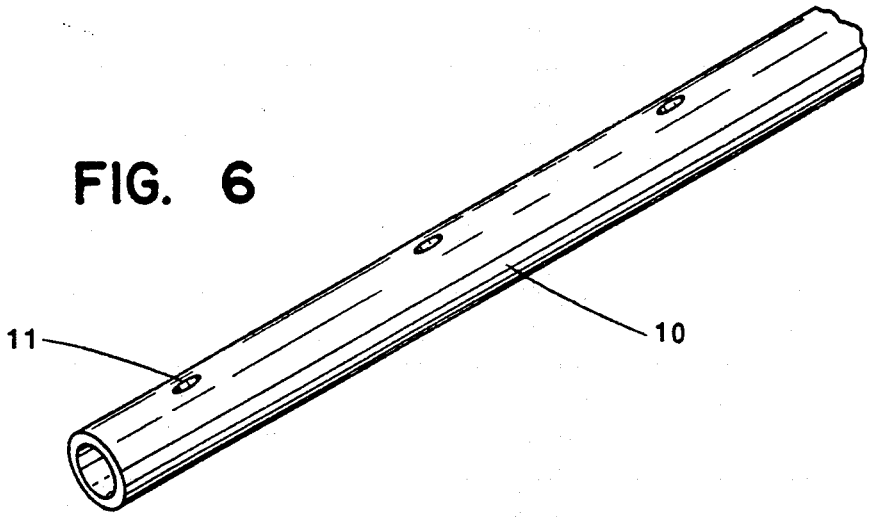
FIG. 6 is a perspective view of a typical section of the wire reinforced tubing having a cylindrical shaped opening bored therein.

Lastly, FIG. 6 illustrates a typical section of the wire reinforced tubing 10 with gas dispensing openings 11. The total cross-sectional area of openings 11 is substantially smaller than the cross-sectional area of the inner diameter of the tubing 10 so that back pressure may be retained within the tubing 10 during operation of the garment so that rapid expansion of gas will result in a change of ambient temperature of the gas. In the preferred embodiment, the tubing 10 has a 3/16 inch inner diameter and openings 11 are seen as having a cylindrical shape. It is not unforeseen that when utilizing gases other than air, different diameter tubing 10 would be more appropriate in addition to openings 11 having either a converging, diverging, or converging-diverging shape to enhance the expansion of the pressurized gas.

It is to be understood that the present invention is not limited to the sole embodiment described above, but encompasses any and all embodiments within the scope of the following claims.

I claim:

1. A body cooling apparatus for cooling the body of a wearer comprising:

a body garment including a supporting layer of material;

a tubing network having interconnected tubing;

said tubing network supported to said supporting layer of material;

a connector on said tubing network;

a plurality of openings in said tubing, wherein said plurality of openings have an aggregate total cross-sectional area less than the cross-sectional area of the inner pathway of said tubing so that pressure may be retained within said tubing resulting in expansion and temperature drop of said gas escaping from said plurality of openings.

2. The body cooling apparatus according to claim 1 being a vest fitted with a face cooling tube;

said face cooling tube has a first end connected to said tubing network and a second end directed toward the face of the wearer of said vest.

3. A method of cooling a human body comprising:

wearing on said body said garment for thereby holding the tubing network adjacent to said body;

introducing pressurized air into said tubing network;

maintaining pressure of said air in said tubing network by limiting escape of said air;

allowing said air to escape and expand through holes in said tubing network;

whereby said escape air drops in pressure and temperature by expansion and cooling said body by convection.

4. The method of claim 3, further limiting said escape of said air through said holes in a direction toward and normal to said body.

* * * * *